US005377805A

United States Patent [19]

Ono et al.

[11] Patent Number: 5,377,805

[45] Date of Patent: Jan. 3, 1995

[54] BILL DISCRIMINATING APPARATUS

[75] Inventors: Takashi Ono, Sakado; Masayuki Watabe, Saitama; Yoshinori Maruyama, Kawagoe, all of Japan

[73] Assignee: Nippon Conlux Co., Ltd., Tokyo, Japan

[21] Appl. No.: 64,868

[22] Filed: May 20, 1993

[30] Foreign Application Priority Data

May 29, 1992 [JP] Japan ..... 4-161645

[51] Int. Cl.[6] ..... G07F 7/04; B65H 5/02

[52] U.S. Cl. ..... 194/206; 271/258

[58] Field of Search ..... 194/206, 207, 350; 271/258, 259, 265

[56] References Cited

U.S. PATENT DOCUMENTS

| | | | |
|---|---|---|---|
| 4,516,899 | 5/1985 | Wood et al. | 271/258 X |
| 4,678,072 | 7/1987 | Kobayashi et al. | 194/206 |
| 4,809,966 | 3/1989 | Kobayashi et al. | 194/206 X |
| 4,878,087 | 10/1989 | Sakai et al. | 271/258 X |
| 4,880,096 | 11/1989 | Kobayashi et al. | 194/206 |
| 5,005,688 | 4/1991 | Yukimoto et al. | 194/206 |
| 5,014,857 | 5/1991 | Kondo | 194/206 X |
| 5,195,739 | 3/1993 | Watabe | 194/206 X |

FOREIGN PATENT DOCUMENTS

| | | |
|---|---|---|
| 0334309 | 9/1989 | European Pat. Off. . |
| 0418098 | 3/1991 | European Pat. Off. . |
| 2039264 | 8/1980 | United Kingdom . |

*Primary Examiner*—Michael S. Huppert
*Assistant Examiner*—Scott L. Lower
*Attorney, Agent, or Firm*—Koda and Androlia

[57] ABSTRACT

A first bill feeding plate 33 and a second bill feeding plate 34 cooperatively constitute a bill feeding passage 31 of a bill discrimination apparatus 1. The first bill feeding plate 33 is formed at a bottom of a casing 67, which is swingably supported on the second bill feeding plate 34 through a hinge shaft 36. An opening lever 82, having an engaging hook 83 and an operating projection 84, is swingably supported at a distal end of the casing 67. The first bill feeding plate 33 is fixed to the second feeding plate 34 when the engaging hook 83 is engaged with an engaging piece 94. Pulling up the operating projection 84 causes the opening lever 82 to start a swing motion about a bearing piece 87.This causes the engaging hook 83 to separate from the engaging piece 94, and the casing 67 rotates in a counterclockwise direction. Thus, the first bill feeding plate 33 separates from the second bill feeding plate 34 to widely open the bill feeding passage.

4 Claims, 6 Drawing Sheets

BILL DISCRIMINATING APPARATUS

BACKGROUND OF THE INVENTION

1. Field of the Invention

The present invention relates to an improvement of a bill discrimination apparatus, more particularly to easy opening/closing operation of a bill feeding passage for the maintenance of bill discriminating means, comprising optical sensor, magnetic head, etc. disposed adjacent to the bill feeding passage or facile removal of a jammed bill from the bill feeding passage.

2. Description of the Prior Art

The bill feeding passage in a bill discrimination apparatus normally consists of a pair of bill feeding plates disposed opposite to each other by being spaced with a predetermined gap, and is equipped with a bill conveyor means comprising belts and rollers and various detecting means, e.g. magnetic head and optical sensor, for discriminating genuine or counterfeit with respect to a bill used.

A long term use of the bill discrimination apparatus causes contamination adhering on belts and rollers, which tends to induce bill slippage, or causes contamination on magnetic heads or optical heads which may disable the normal bill discriminating function. Furthermore, there is a possibility that the bills are jammed during conveyance through the bill feeding passage.

Such circumstances thus force an operator to occasionally open the bill feeding passage for cleaning belts, rollers, magnetic head and optical sensors, or for removing a jammed bill.

In order to facilitate opening/closing operation of the bill feeding passage required for occasional maintenance, there has already been proposed a bill discrimination apparatus in which one bill feeding plate is hingedly supported at its base end in order to be fixed to the other bill feeding plate at its distal end by means of a screw, e.g. a wing nut equipped with a grip. Loosening and fastening the screw by turning its grip was, however, is too time-consuming to contribute to the speeding of the opening/closing operating of the bill feeding passage for the maintenance or removal work.

Furthermore, some other bill discrimination apparatus have been also proposed, in which one bill feeding plate is hingedly supported at its base end in order to be fixed to the other bill feeding plate in the same manner but is fixed at its distal end to the same of the other by other fixing means such as various engaging pieces or latch mechanisms. In opening the bill feeding passage, however, such conventional apparatus requires an operator two different motions: one is to rotate a swing lever provided on the fixed bill feeding plate and the other is to lift up the swingable bill feeding plate. (For example, refer to Japanese Patent Publication No. SHO 62-215461 whose counterpart application is the U.S. Pat. No. 4,809,966 or Japanese Patent Publication No. HEI 3-10156 whose counterpart application is the U.S. Pat. No. 4,678,072.) Any of these is characterized in that two different operating motions, i.e., releasing the swingable bill feeding plate from the fixed bill feeding plate and opening the swingable one about the fixed one, require an operator using both hands at the same time, because these two motions are not incorporated with each other. Therefore, troublesome cooperative labor is required to open the bill feeding passage.

OBJECT AND SUMMARY OF THE INVENTION

Thus, the object of the present invention, in view of above-described problems or disadvantages of the prior arts, is to provide a bill discrimination apparatus which is capable of easily opening or closing the bill feeding passage with simple one-motion operation.

In order to accomplish the above object, a first aspect of the present invention provides a bill discrimination apparatus comprising:

first and second bill feeding plates confronting each other to form a bill feeding passage having a predetermined clearance therebetween;

a bill conveyor means equipped in said bill feeding passage and a detecting means for discriminating a bill conveyed by said bill conveyor means; wherein said first bill feeding plate is hingedly supported at its base end on said second bill feeding plate;

a bill feeding plate opening lever is hingedly supported with a shaft on the swingable end of said first bill feeding plate, urged in the same direction as the closing direction of the first bill feeding plate and provided with an engaging hook at its one end and an operating projection at the other end; and an engaging piece engages with the engaging hook of said bill feeding plate opening lever so that said first bill feeding plate can be positioned to form said bill feeding passage.

Furthermore, a second aspect of the present invention provides a bill discrimination apparatus comprising:

a swing unit, whose casing containing a bill discriminating means and having a bottom surface formed into a first bill feeding plate, being swingably supported on an exterior member forming a main body;

a second bill feeding plate being fixed to said exterior member;

said swing unit being cooperative with said second bill feeding plate to form a bill feeding passage having a predetermined clearance therebetween when said swing unit is swung to make said first bill feeding plate confront said second bill feeding plate;

an opening lever swingably supported at a distal end of said casing and having an engaging hook at one end thereof and an operating projection at the other end thereof;

an urging means for urging said opening lever in the same direction as a closing direction of said casing;

said operating projection is provided in such a manner that said opening lever causes a swing motion in a reverse direction against urging force of said urging means when a force for opening said swing unit is given to said operating projection; and an engaging piece, provided on said exterior member, being engaging with said engaging hook of said opening lever to prevent said swing unit from swinging so that said first and second bill feeding plates form the bill feeding passage.

Moreover, in accordance with a third aspect of the present invention, said opening lever includes an almost rectangular base plate, extension arms extending forward from right and left sides of the base plate, a plurality of bearing pieces extending toward said casing from above said base plate, and an operating projection projecting far from above said casing in the direction reverse to the direction of said casing; and said extension arm has a lower end being formed into said engaging hook protruding toward said casing. The third aspect of the present invention further comprising: a shaft laterally provided in said casing at a place adjacent to said distal end for rotatably supporting said bearing pieces; and a spring wound around said shaft for urging said engaging hook at the lower end of the extension arm of the bill feeding plate opening lever toward said casing.

Still further, in accordance with a fourth aspect of the present invention, said engaging hook has a tapered guide surface so that, when said swing unit is closed, said opening lever rotates in the reverse direction against urging force of said spring.

In accordance with the present invention, when the opening lever of the first bill feeding plate is pulled up, the opening lever rotates about its hinge shaft in the reverse direction against urging force of the spring. And, the engaging hook provided at the other end of the operating projection is disengaged from the engaging piece. Further pulling the opening lever causes the first bill feeding plate to start a swing motion in its opening direction to open the bill feeding passage.

In closing operation, the first bill feeding plate is pressed down from its opened position to a closed position, in which first and second bill feeding plates confront each other maintaining a predetermined gap. In this closed condition, the engaging hook of the opening lever engages with the engaging piece with assistance of the urging means which urges the opening lever in the same direction as the closing direction of the first bill conveyor plate. Thus the first bill feeding plate fixedly maintained to form the bill feeding passage.

Consequently, in accordance with the bill discrimination apparatus defined by the present invention, one of bill feeding plates constituting the bill feeding passage has a base end being swingably supported on the other bill feeding plate and a distal end provided with an opening lever urged in the same direction as the closing direction of this swingable bill feeding plate. And, an engaging hook is provided at one end of the opening lever to engage with an engaging piece provided on a fixed main body of the apparatus. Accordingly, the bill feeding passage can be surely opened by a simple manipulation, simply pulling the operating projection towards the opening direction of the bill feeding plate.

The above and other objects, features and advantages of the present invention will become more apparent from the following detailed description which is to be read in conjunction with the accompanying drawings.

DETAILED DESCRIPTION OF THE PREFERRED EMBODIMENT

Figure 1A:
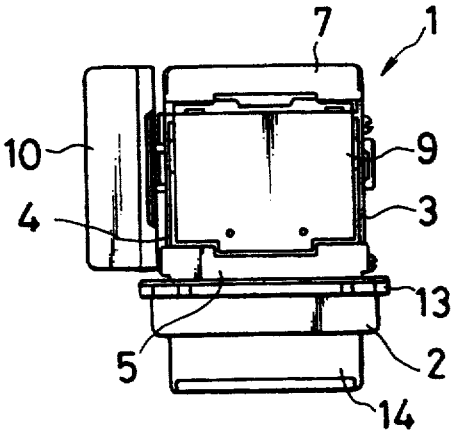
FIGS. 1(*a*), 1(*b*), 1(*c*), 1(*d*), and 1(*e*) are views respectively showing an appearance of a bill discrimination apparatus in accordance with an embodiment of the present invention.
Figure 1B:
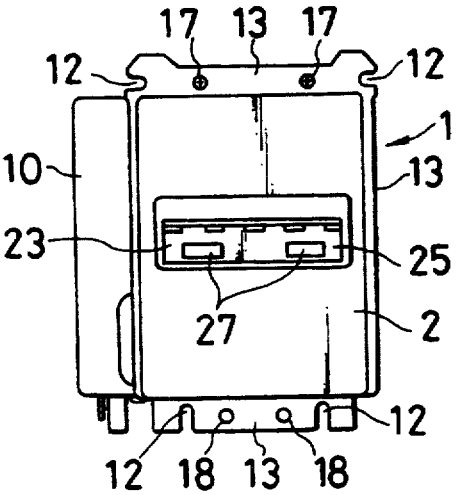
Figure 1C:
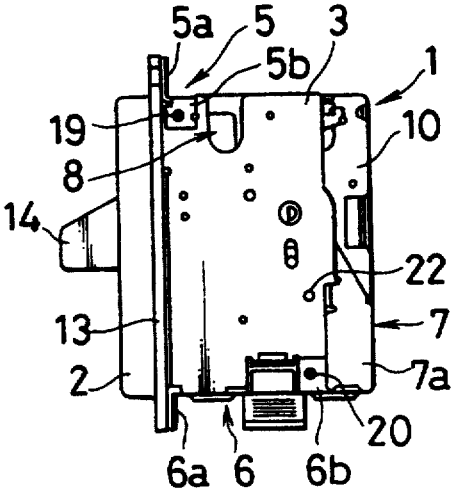
Figure 1D:
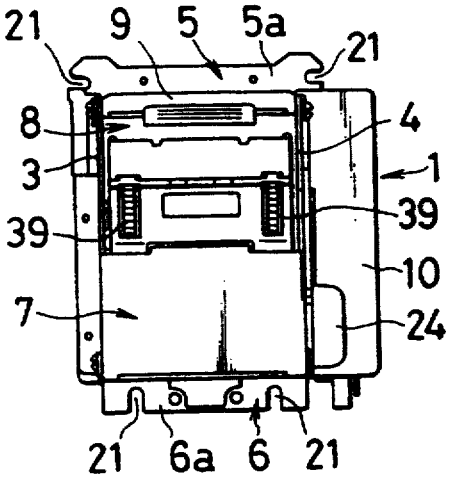
Figure 1E:
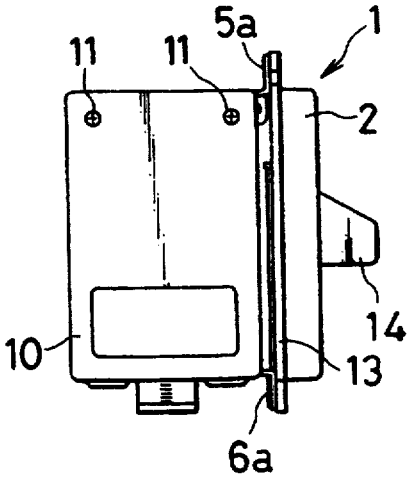
Figure 2:
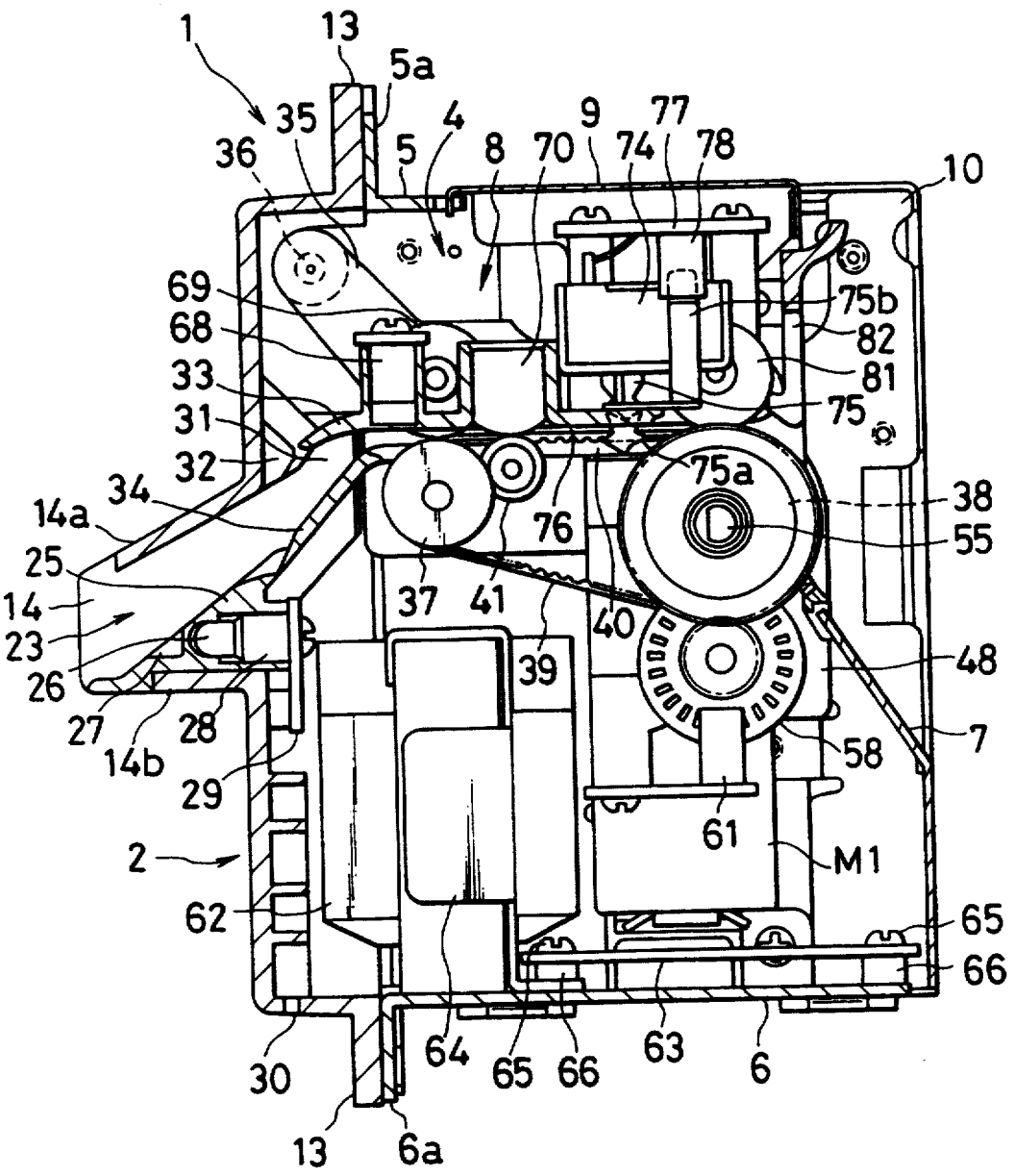
FIG. 2 is a cross-sectional view showing an inside structure of the bill discrimination apparatus in accordance with the embodiment of the present invention.
Figure 3:
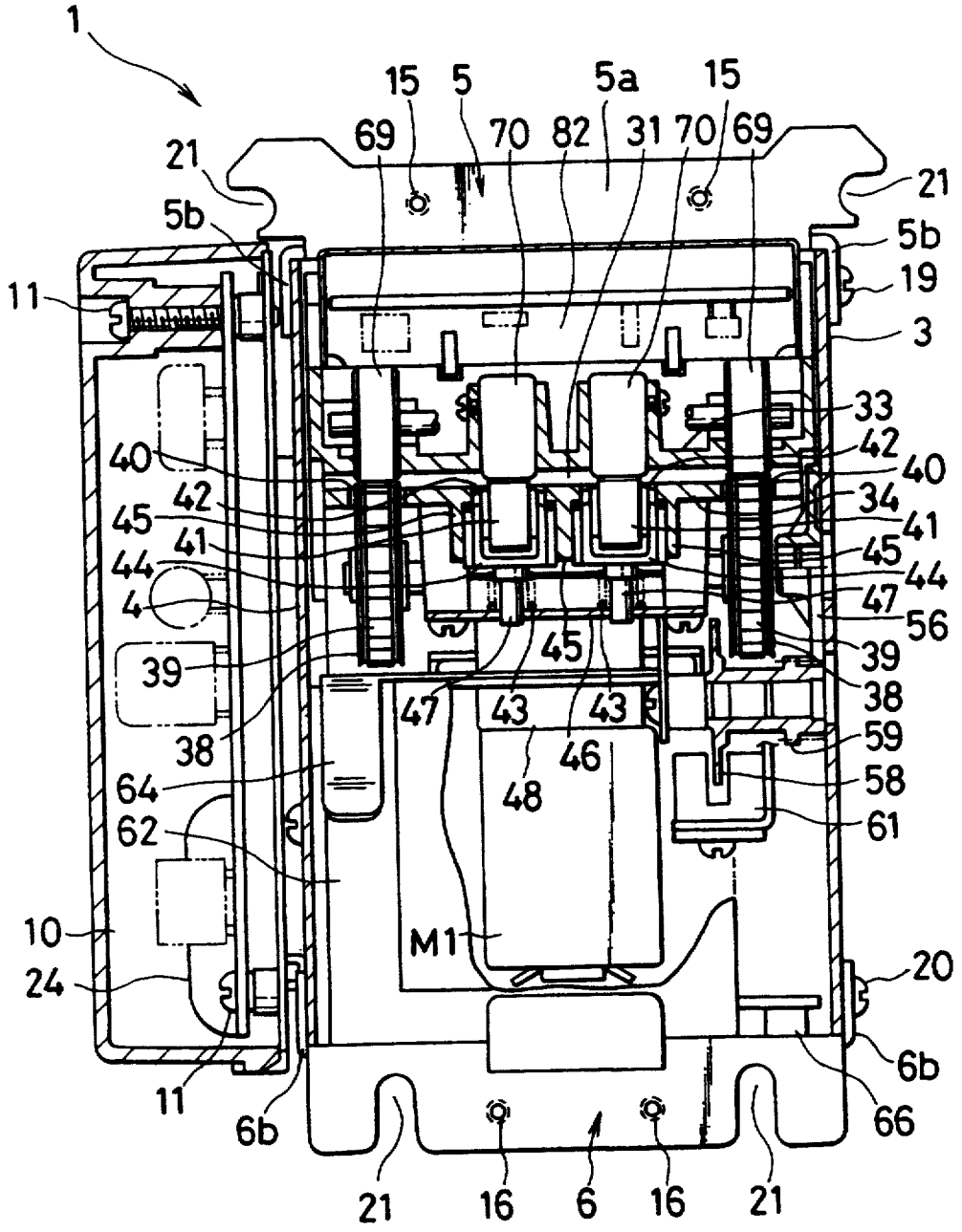
FIG. 3 is a cross-sectional view showing an inside structure of the bill discrimination apparatus in accordance with the embodiment of the present invention.

Hereinafter, with reference to accompanying drawings, one preferred embodiment of the present invention will be explained in detail. FIGS. 1(*a*) through 1(*e*) are views respectively showing an appearance of a bill discrimination apparatus 1 in accordance with one embodiment of the present invention, wherein FIG. 1(*a*) is a plane view, FIG. 1(*b*) a front view, FIG. 1(*c*) a right side view, FIG. 1(*d*) a rear view, and FIG. 1(*e*) a left side view, respectively. FIGS. 2 and 3 awe a cross-sectional view showing an inside structure of the bill discrimination apparatus 1, wherein FIG. 2 is a vertical sectional view corresponding to FIG. 1(*c*) and FIG. 3 is a vertical sectional view corresponding to FIG. 1(*b*).

An exterior of the bill discrimination apparatus 1, as shown in FIGS. 1(*a*) through 1(*e*), consists of a front mask 2 covering a front side, right and left side plates 3 and 4 covering both right and left sides, a bracket member 5 constituting a part of an upper surface, a bottom plate 6 constituting a lower surface, a rear plate 7 covering a rear side, and an upper plate 9 serving as a cover member of a swing unit 8 which is swingably disposed at an upper portion thereof.

By means of a plurality of screws 11, the left side plate 4, as shown in FIG. 1(*d*), is fixed with a control box 10, which accommodates various electric components, including a micro processor, for driving and controlling various portions therein. The control box 10 has a cutout 24 formed on a rear surface thereof, which serves as a cord hole for taking a cord connected to a control board out of the control box 10.

The front mask 2 is of a synthetic resin integrally fabricated, for example, by injection molding. As shown in FIG. 1(*b*), the upper and lower peripheral portions of the front mask are formed into flange portions 13 and 13, which have U-shaped cutouts 12, . . . 12 opening at each corner thereof.

A bracket member 5 and a bottom plate 6 are made of metal plate. As shown in FIG. 1(*c*), 1(*e*) and FIG. 2, the bracket member 5 and the bottom plate 6 have a front end portion 5*a* and a front end portion 6*a* respectively, which bend perpendicularly to extend outwards. These front end portions 5*a* and 6*a* have two pairs of female screws 15, 15 and 16, 16, respectively, formed by tapping. (Refer to FIG. 3) The fixation of the front mask 2 onto the bracket member 5 and the bottom plate 6 is done by driving male screws 17, 17 and 18, 18 into female screws 15, 15 and 16, 16, respectively.

Furthermore, the bracket member 5 and the bottom plate 6 have tongue-shaped pieces 5*b*, 5*b* and 6*b*, 6*b* formed to bend at both ends thereof. These tongue-shaped pieces 5*b*, 5*b* and 6*b*, 6*b* respectively have screw holes (not shown) into which screws 19, 19 and 20, 20 are inserted when the bracket member 5 and the bottom plate 6 are fixed to right and left side plates 3, 4 of metal plate as shown in FIG. 1(*c*) and FIG. 3.

The exterior members are integrally assembled as described above.

The configuration of front end portions 5*a* and 6*a* of the bracket member 5 and the bottom plate 6 are substantially identical with the upper and lower flanges 13, 13, as shown in FIGS. 1(*d*) and 3. In the same manner, U-shaped cutouts 21, . . . , which are identical with the cutouts 12, . . . of the flange portions 13, 13, are formed on the front ends 5*a*, 6*a*.

The rear plate 7 covering the rear side of the bill discrimination apparatus 1 has a pair of bent portions 7*a*, 7*a* formed by being bent perpendicularly at right and left ends thereof. The fixation of the rear plate 7 onto the right and left side plates 3 and 4 is done by placing the bent portions 7*a*, 7*a* inside the right and left side plates 3, 4 to partly cover both sides of the apparatus 1 and also by driving screws 22, 22 from the outside into screw holes (not shown) opened on the right and left side plates 3, 4 as shown in FIG. 1(*c*).

In installing this bill discrimination apparatus 1 on a vending or game machine, the front mask 2 is first coupled with a rectangular opening formed on the bill discrimination apparatus 1 from the inside thereof. Next, bolts (not shown) are inserted through U-shaped cutouts 12, . . . , 21 . . . formed on the flange portions 13, 13 of the front mask 2 and the frond ends 5*a*, 6*a*, which are to cover the flange portions, of the bracket member 5 and bottom plate 6 to fix the front mask 2 onto the vending or game machine together with the bracket member 5 and the bottom plate 6.

Furthermore, as shown in FIGS. 1(*b*) and 1(*c*), the front mask 2 has, at its integral part, a bezel 14 protruding forward from the front end thereof, which is equipped with a bill insertion hole 23. A bill is inserted into the bill discrimination apparatus 1 through this bill insertion hole 23 in a manner described later.

Next, an internal construction of the bill discrimination apparatus 1 will be explained chiefly with reference to FIGS. 2 and 3.

A coupling member 25, disclosed in FIGS. 1(*b*) and 2, engages with a lower bezel 14*b* constituting a part of the bezel 14 so as to entirely cover an upper surface of the lower bezel 14*b*. Two light emitting diodes 26, 26 are disposed symmetrically behind this coupling member 25 on right and left thereof when seen from the front side. This coupling member 25, made of colored semi-transparent synthetic resin material, has an upper surface inclining at a predetermined angle with respect to the surface of the upper bezel 14*a*. The upper surface of the coupling member 25 is, however, partly formed into stepped recesses 27, 27 just in front of two light emitting diodes 26, 26 so that sufficient quantity of light can be emitted toward the front end of the front mask 2, as shown in FIGS. 1(*b*) and 2.

The light emitting diode 26 is fixed through a lamp socket 28 and a lamp base plate 29 to the inside of the body of the front mask 2, as shown in FIG. 2. The main body of the front mask 2 has a drain 30 opened at a lower part thereof in order to drain water such as the rainwater entered therein, and further has ribs 32 protruding inward from the position corresponding to the upper bezel 14*a* at a predetermined lateral intervals. The ribs 32 constitute a guide member together with the inside surface of the upper bezel 14*a* and the inclined surface of the coupling member 25 so as to guide an inserted bill into a later described bill feeding passage 31.

The bill feeding passage 31 consists of a first bill feeding plate 33 and a second bill feeding plate 34 positioned below the first bill feeding plate 31, as shown in FIG. 2 (and FIG. 6(*a*)). The beginning end of the bill feeding passage 31 is arranged opposite to the bill insertion hole 23 of the bezel 14. The first bill feeding plate 33 is swingably supported between right and left side plates 3, 4 so as to cause a swing motion about hinge shafts 36, 36 through arms 35, 35 extending forward from both sides thereof, and constitutes a part of a swing unit 8 as will be described later. On the other hand, the second bill feeding plate 34 is rigidly fixed between the right and left side plates 3, 4.

The second bill feeding plate 34 accompanies a pair of driven timing pulleys 37, 37 rotatably positioned close to the front mask 2 below the right and left sides thereof. In the same manner, the second bill feeding plate 34 also accompanies a pair of drive timing pulleys 38, 38 rotatably positioned close to the rear plate 7 below the right and left sides thereof. An endless timing belt 39, which constitutes a bill feeding means, is wound around these drive and driven pulleys 37, 38.

As shown in FIGS. 2 and 3, the second bill feeding plate 34 has a pair of longitudinally extending holes 40, 40 along a bill feeding direction, opened at the positions just corresponding to the pulleys 37, 38; through these holes 40, 40, the timing belts 39, 39 protrude upward slightly from the lower side of the second bill feeding plate 34 and enter into the bill feeding passage 31 so as to contact with a bill being conveyed therein. The drive timing pulleys 38, 38 with the timing belt wound therearound are connected to and driven by a DC motor M1 through various power transmitting means provided in a gear case 48.

Figure 5A:
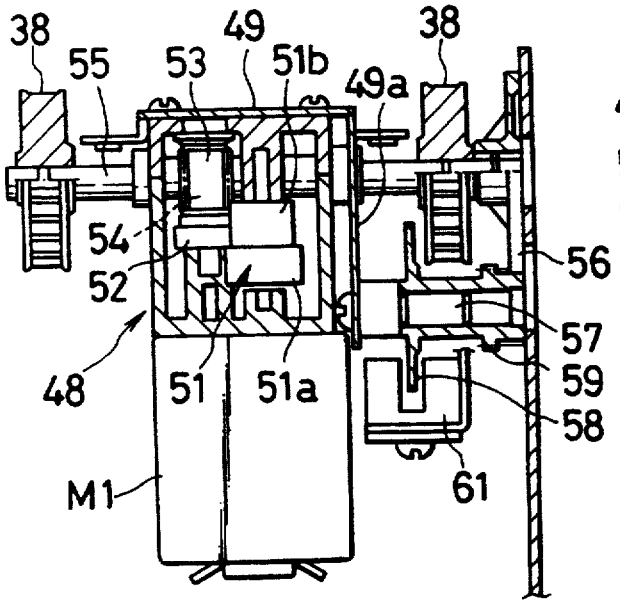
FIGS. 5(*a*) and 5(*b*) are fragmentary sectional views showing a detailed configuration of a power transmission mechanism of the bill discrimination apparatus in accordance with the embodiment of the present invention.
Figure 5B:
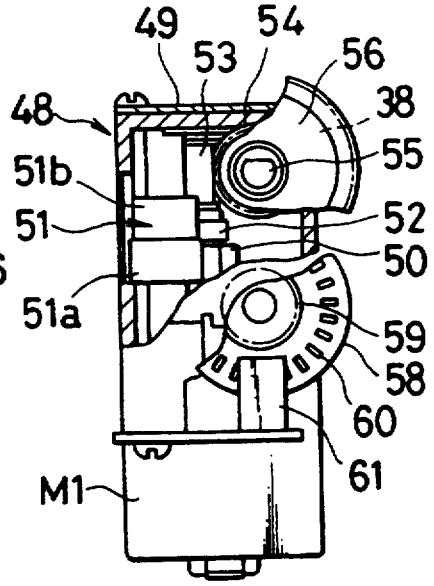

FIGS. 5(*a*) and 5(*b*) are fragmentary sectional views respectively showing a detailed configuration of a power transmission mechanism which actuates the drive timing pulleys 38. FIG. 5(*a*) is a fragmentary sectional view showing the gear case 48 and the DC motor M1 seen from the same direction as FIG. 3, while FIG. 5(*b*) is a fragmentary sectional view showing the gear case 48 and the DC motor M1 seen from the same direction as FIG. 2.

As shown in FIGS. 5(*a*) and 5(*b*), the gear case 48 accommodating various power transmitting means is fixed through a bracket 49 to the reverse side of the second bill feeding plate 34. The DC motor M1 is attached beneath the gear case 48 in such a manner that its rotational shaft is inserted inside the gear case 48 from the bottom.

The rotational shaft, inserted inside the gear case 48, is fixed to a pinion gear 50, which meshes with a large diameter gear 51*a* of a stepped spur gear 51 rotatably supported in the gear case 48. The stepped spur gear 51 includes a small diameter gear 51*b* integrally formed together with the large diameter gear 51*a*. The small diameter gear 51*b* of the stepped spur gear 51 meshes with another spur gear 52 rotatably supported in the gear case 48. A worm gear 53, provided coaxially with this spur gear 52, rotates integrally with the spur gear 52. A drive shaft 55, having both of its ends fixed with the drive timing pulleys 38, 38, is inserted into the gear case 48 so as to be rotatable but not slidable thereround. This drive shaft 55 has a worm wheel 54 fixed at about the center thereof, which meshes with the worm gear 53.

The drive timing pulley 38, fixed to one end of the drive shaft 55, has an outside connected to a large diameter spur gear 56 which rotates together to the drive timing pulley 38. The bracket 49 has a bent portion 49*a*, on which a shaft 57 is mounted. This shaft 57 rotatably supports a punched disk 58 which is coaxial and integral with a small diameter gear 59. This small diameter gear 59, disposed on the punched disk 58 which is rotatably supported on the shaft 57, meshes with the spur gear 56. The punched disk 58 has a plurality of slits 60 opened thereon in a circumferential direction at equal intervals as shown in FIG. 5(*b*). Moreover, this punched disk 58 is positioned close to a rotational speed detector 61 in such a manner the punched disk 58 interposes between a light emitting element and a photoelectric converter housed in the rotational speed detector 61. The bracket 49 supports this rotational speed detector 61.

Accordingly, an actuation of the DC motor M1 causes a rotation of the pinion gear 50, whose rotation is transmitted to the worm gear 53 through the large diameter gear 51*a* and small diameter gear 51*b* of the stepped spur gear 51 and the spur gear 52. Then, the rotation of the worm gear 53 is transmitted to the worm wheel 54 to rotate the drive shaft 55, thereby causing a rotation of the drive shaft 55 and each drive timing pulley 38 fixed on the drive shaft 55. The drive timing pulley 38 cooperates with the driven timing pulley 37 to rotate an endless timing belt 39 wound around them.

In this case a rotation of the spur gear 56, integrally rotating with the drive timing pulley 38, is transmitted through the small diameter gear 59 to the punched disk 58. This punched disk 58 rotates at a predetermined rotational speed proportional to that of the drive timing pulley 38. Therefore, the rotational speed detector generates a rotational position detecting signal each time the drive timing pulley 38 rotates a predetermined amount.

Returning to FIGS. 2 and 3, a pair of pinch rollers 41, 41 is provided below the second bill feeding plate 34 between the driven and drive timing pulleys 37, 38. The pinch rollers 41, 41 are spaced providing a predetermined distance in a widthwise direction and disposed in parallel with each other. These pinch rollers 41, 41 are rotatably mounted on bracket members 44, 44, which are inserted slidably in sliding sleeve 45, 45 protruding from the reverse side of the second bill feeding plate 34, as shown in FIG. 3. Each pinch roller 41 is always urged to protrude from the upper surface of the second bill feeding plate 34 by means of a spring 43, which is interposed between the plate 46 and the bracket member 44. The plate 46 is spaced providing a predetermined distance from the sleeve 45 and fixed to the reverse side of the second bill feeding plate 34.

Furthermore, the second bill feeding plate 34 has rectangular through holes 42, 42 opened thereon at the places corresponding to the positions of the bracket members 44, 44. These through holes 42, 42 allow the pinch rollers 41, 41 to protrude into the bill feeding passage 31 by being urged with the springs 43, 43. On the other hand, peripheral portions of the through holes 42, 42 prevent the bracket members 44, 44 from protruding beyond the second bill feeding plate 34, so that the protruding amount of the pinch roller 41 can be suppressed within a predetermined range.

A supporter 47, around which the spring 43 is wound, is integrally fixed to the bottom surface of the bracket member 44 to prevent the dislocation. The lower part of the supporter 47 extends through the plate 46 and moves together with the bracket member 44 in an up-and-down direction.

A reference numeral 62 represents a power transformer; a reference numeral 64, a bracket which fixes the power transformer 62 on the bottom plate 6; and a reference numeral 63 (refer to FIG. 2), an electric power board which distributes electric power to various components such as DC motor M1 and detectors. As these electric components are well known, explanations of their constructions and functions will be omitted here. The bracket 64 and the electric power board 63 are fixed from inside through screws 65, 65 and an insulation spacer 66 onto the bottom plate 6.

Next, with reference to FIGS. 6(*a*) and 6(*b*), an exterior of the swing unit 8, including the first bill feeding plate 33 as one component, will be explained. The swing unit 8 comprises a tray casing 67 made of synthetic resin material as shown in the drawing. The bottom portion of this casing 67 forms the previously described first bill feeding plate 33. By the way, FIGS. 6(*a*) and 6(*b*) are plane and right side views simply showing an appearance of the casing 67 constituting the exterior of the swing unit 8 and schematically illustrating a mutual relationship between the first bill feeding plate 33 and the second bill feeding plate 34, respectively. Therefore, in these FIGS. 6(*a*) and 6(*b*), illustrations of constitutional relationships with other components are omitted.

With reference to FIGS. 2 and 3, various members arranged on the first bill feeding plate 33, which is formed with the bottom of the casing 67, will be explained in the order of their locations along the direction in which the bills are fed. First, photoelectric converters 68, 68 are provided at both ends of the upper surface close to the front mask 2, or in the vicinity of an inlet of the bill feeding passage 31. These photoelectric converters 68, 68, each serving as a part of an optical sensor for detecting an insertion of bill, are arranged in parallel with each other and spaced with a predetermined clearance in a lateral direction of the bill feeding passage 31.

Next, two guide rollers 69, 69 are rotatably supported confronting driven timing pulleys 37, 37 which are positioned below the second bill feeding plate 34. Constitutions of these guide rollers 69, 69 are substantially identical to those of pinch rollers 41, 41 disposed on the second bill feeding plate 34. Thus, these guide rollers 69, 69 are urged to protrude into the bill feeding passage 31 in the same manner as the pinch rollers 41, 41, thereby enabling a bill to be pressed and sandwiched between these guide rollers 69, 69 and the timing belt 39 wound around the driven timing pulley 37.

Next, two magnetic heads 70, 70 are provided on the first bill feeding plate 33 in parallel with each other corresponding with the positions of the pinch rollers 41, 41 on the second bill feeding plate 34. These magnetic heads 70, 70 read from the bills the information necessary to discriminate genuine bills from counterfeit bills and denominations of bills while the bills pressed against the pinch rollers 41, 41 are conveyed along the bill feeding direction.

Figure 4A:
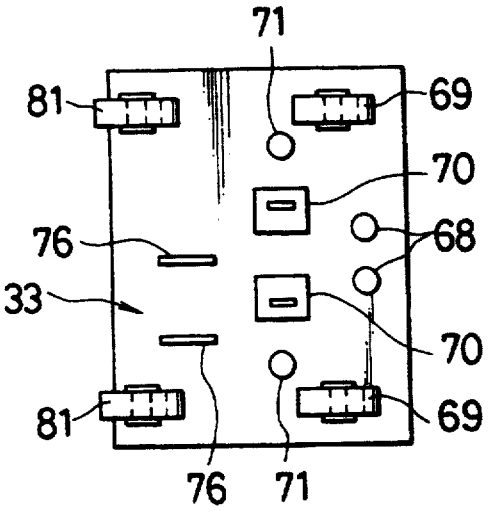
FIGS. 4(*a*) and 4(*b*) are views showing a layout of various sensors disposed in the bill discrimination apparatus in accordance with the embodiment of the present invention.
Figure 4B:
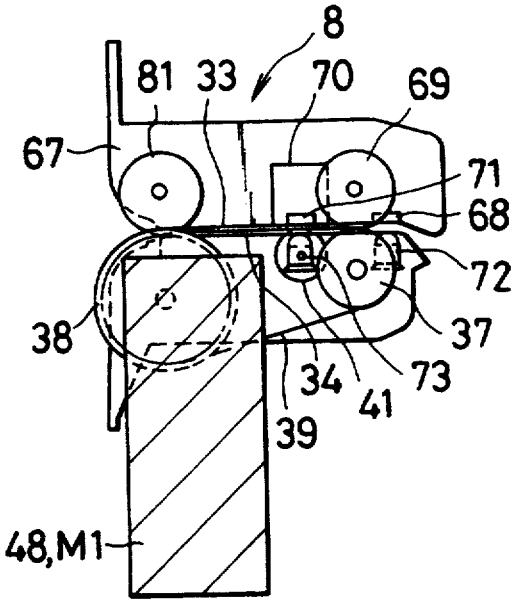

Though not specifically shown in FIGS. 2 and 3, as shown in FIGS. 4(*a*) and 4(*b*), two photoelectric converters 71, 71 are installed in parallel with but outside the magnetic heads 70, 70 at predetermined intervals in the lateral direction of the bill feeding passage 31. These photoelectric converter 71 constitute a part of an optical sensor serving as a bill passage position detecting sensor.

Furthermore, the second bill feeding plate 34 is provided with two sets of light emitting elements 72, 72 and 73, 73, respectively corresponding with the positions of the photoelectric converters 68, 68 serving as a part of the optical sensor for detecting an insertion of bill and the photoelectric converters 71, 71 serving as a part of the bill passage position detecting sensor.

Further referring to FIGS. 2 and 3, explanation of various members disposed on the first bill feeding plate 33 will be continued. Located a little bit downstream from the magnetic head 70 along the bill insertion direction is an automatic return pull-type solenoid 74, which is fixed through a bracket 77 to the casing 67. This solenoid 74 comprises an automatic return spring cooperative with its movable core. This automatic return spring allows the movable core to protrude downward when the solenoid 74 is deactivated, while the movable core retracts when the solenoid 74 is activated. This movable core of the pull-type solenoid 74 has a distal end fixed to a shutter member 75. This shutter member 75 has bifurcated ends **75*a*, 75*a*, which are fabricated through the press working and will be explained in more detail with reference to FIGS. 8(*a*)–8(*b*)**.

When the solenoid 74 is deactivated, the bifurcated ends **75*a*, 75*a* of the shutter member 75 protrude into the bill feeding passage 31 through the slits 76, 76 opened on the first bill feeding plate 33. These bifurcated ends 75*a*, 75*a* can also protrude downward below the second bill feeding plate 34 through slits (not shown). The shutter member 75 further includes an integrally formed shielding plate 75*b*. The bracket 77, mounted with the pull-type solenoid 74, is equipped with a pair of photoelectric converter and light emitting element cooperatively constituting a shutter sensor 78. The shielding plate 75*b* is interposed between the photoelectric converter and the light emitting element of the shutter sensor 78**.

Only when the bifurcated ends **75*a*, 75*a* of the shutter member 75 pass through slits formed on both first and second bill feeding plates 33, 34, the shielding plate 75*b* goes out of the interspace between the photoelectric converter and the light emitting element, while the shielding plate 75*b* comes between the photoelectric converter and the light emitting element when the bifurcated ends 75*a*, 75*a* of the shutter member 75 is between the first bill feeding plate 33 and the second bill feeding plate 34, or when the bifurcated ends 75*a*, 75*a* retract above the slits 76 of the first bill feeding plate 33**.

Accordingly, the shutter sensor 78 detects the shielding plate **75*b* when the pull-type solenoid 74 is activated to completely retract the bifurcated ends 75*a*, 75*a* of the shutter member 75 above the slits 76 of the first bill feeding plate 33 and when downward movement of the bifurcated ends 75*a*, 75*a* from their retracted positions in response to the deactivation of the pull-type solenoid 74 to enter into the slits of the second bill feeding plate 34 is prevented due to the presence of a bill and the like. On the other hand, the shutter sensor 78 does not detect the shielding plate 75*b* when the bifurcated ends 75*a*, 75*a* of the shutter member 75 extend downward below the slits of the second bill feeding plate 34 through the bill feeding passage 31**.

Referring now to FIGS. **8(*a*) to 8(*d*), configuration of the shutter member 75 fixed to the distal end of the movable core of the pull-type solenoid 74 will be explained. FIG. 8(*a*) is a plane view; FIG. 8(*b*), a right side view; and FIG. 8(*c*), a front view. However, these plane, right side, and front views respectively show only the relative positions within these and FIGS. 8(*a*)–8(*c*), and therefore it should be noted that they have no correlation with each drawing of FIGS. 1 to 7**.

This shutter member 75, made of metal plate by press working, has a base plate **75*c* secured to the movable core of the pull-type solenoid 74 by rivet or brazing means. Previously described bifurcated parallel ends 75*a*, 75*a* are formed by bending both ends of this base plate 75*c* to extend almost perpendicularly. Furthermore, an extension arm 75*d* extends from this base plate 75*c* toward the other end like a tongued piece. The front end of this extension arm 75*d* is bent perpendicularly in a direction opposite to the bifurcated ends 75*a*, 75*a* to form the previously explained shielding plate 75*b***.

Each of bifurcated ends **75*a*, 75*a* has round cutouts 70*a*, 79*b* at both edges of its middle portion as shown in FIG. 8(*d*). At the points on both sides closer to the distal end than the cutouts 79*a*, 79*b*, these are provided a round projection piece 80*a* and a sharp wedge-shaped projection piece 80*b*. Furthermore, there is provided a dull wedge-shaped projection 80*c* at the distal end of 75*a***.

A double dot and dash line of FIG. 8 represents an end of the movable core of the pull-type solenoid 74. The shutter member 75 is fixed with the movable core at substantially the center of the base plate **75*c* so that the projection piece 80*b* faces the bill insertion direction (the rightward direction in FIG. 2), and the shielding plate 75*b* faces upward (toward the shutter sensor 78**).

Returning again to FIGS. 2 and 3, at the place located a little bit downstream from the pull-type solenoid 74 along the bill insertion direction, two parallel guide rollers 81, 81 are rotatably supported by the first bill feeding plate 33, confronting the drive timing pulleys 38, 38 disposed below the second bill feeding plate 34. These guide rollers 81, 81 are identical in construction to previously described guide rollers 69, 69. A bill is pressed and sandwiched between this guide rollers 81, 81 and the timing belt 39, 39 wound around the drive timing pulleys 38, 38.

Of the various components provided on the first and second bill feeding plates 33, 34, the light emitting element 72 (FIG. **4(*b*)) and the photoelectric converter 68 constitute the bill insertion sensor which detects whether or not a bill is actually inserted. On the other hand, the magnetic heads 70, 70, light emitting elements 73, 73 and photoelectric converters 71, 71 constitute the bill passage position detecting sensor (FIGS. 4(*a*) and 4(*b*)**), which detects the present position of a fed bill. To collect data required for bill discrimination, these two sensors detect light transmittance of each bill on the basis of the light receiving condition of the photoelectric converter. More particularly, the bill insertion sensor and the bill position detecting sensor cooperate with each other to function as a bill discrimination means.

Referring now to FIGS. **4(*a*) and 4(*b*), positional relation ship of various sensors, which are disposed on the first bill feeding plate 33, formed by the bottom portion of the casing 67, and the second bill feeding plate 34, will be explained. FIG. 4 (*a*) is a plane view schematically showing the first bill feeding plate 33, and FIG. 4(*b*) is a front view corresponding to FIG. 4(*a*). However, FIG. 4(*b*) is a schematic view showing the first and second bill feeding plates 33, 34 seen from the same direction as FIG. 1(*e*), while FIG. 4(*a*) is a plane view corresponding to FIG. 4(*b*)**. Thus, it should be noted that the bill insertion direction in FIG. 4(*b*) is right to left, which is opposite to that in FIG. 2.

An upper plate 9 is provided covering an upper surface of the casing 67, which contains the photoelectric converters 68, 71, the magnetic heads 70, 70, and the pull-type solenoid 74, to protect such electric component installed therein. A unit body including the casing 67, various electric components housed therein, and the upper plate 9, is integrally formed as the swing unit 8 and supported about hinge shafts 36, 36 to permit a swing motion. With this swing motion, the first bill feeding plate 33, which is the bottom surface of the casing 67 and constitutes the swing unit 8, is allowed to approach to or separate from the second bill feeding plate 34.

Figure 6A:
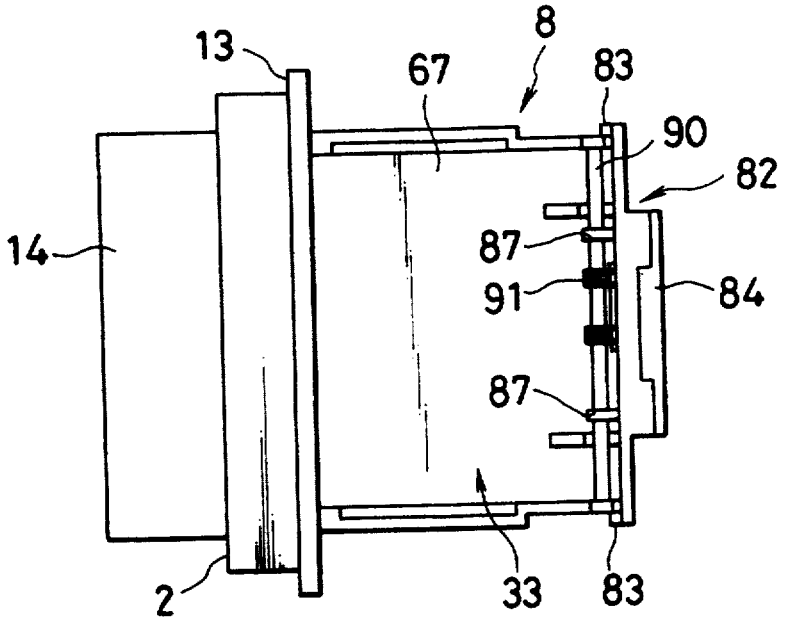
FIGS. 6(*a*) and 6(*b*) are schematic views showing a swing unit of the bill discrimination apparatus in accordance with the embodiment of the present invention.
Figure 6B:
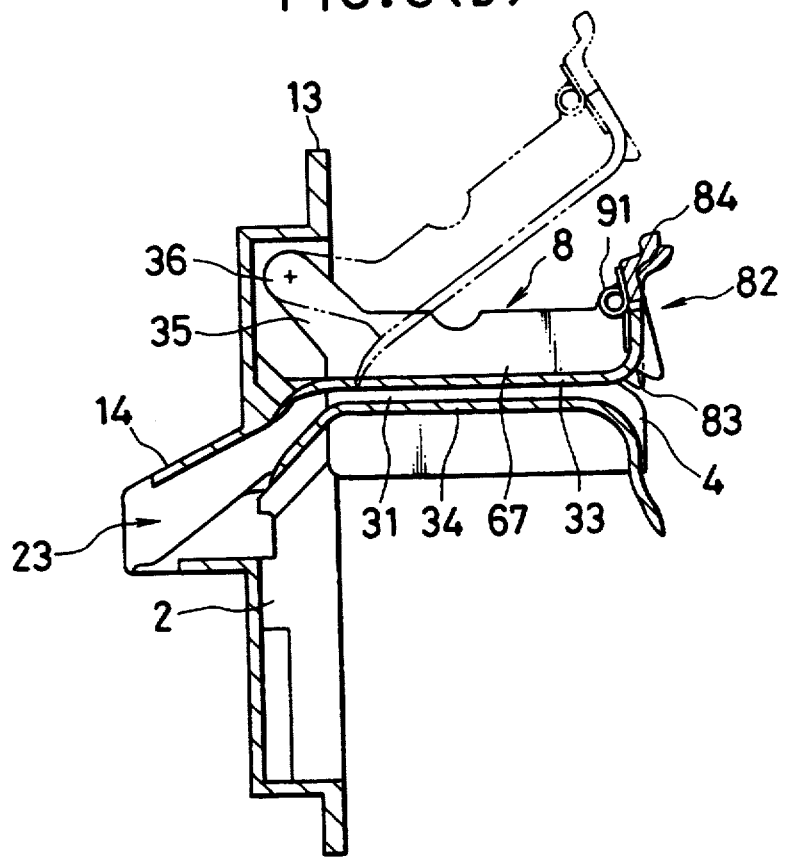

With reference to FIGS. 6(*a*) and 6(*b*), an opening condition wherein the swing unit 8 is widely opened to separate from the first bill feeding plate 33 and a closing condition wherein the swing unit 8 is closed to form the bill feeding passage 31 between the first and second bill feeding plates 33, 34 will be explained.

Solid lines of FIG. 6(*b*) show a closed condition in which the first and second bill feeding plates 33, 34 forms the bill feeding passage 31. In this condition, as shown in FIG. 4(*b*), the guide rollers 69, 81 are pressed against the timing belts 39, 39 wound around the pulleys 37, 38, and the pinch rollers 41 are pressed against the magnetic heads 70, 70 to form a predetermined clearance between the first and second bill feeding plates 33, 34.

A bill feeding plate opening lever 82 is provided at a distal end (an opposite side of the hinge shaft 36) of the casing 67 constituting the swing unit 8. This bill feeding plate opening lever 82 is manipulated for causing the swing unit 8 to swing about the hinge shafts 36, 36 to open or close the bill feeding passage 31. This bill feeding plate opening lever 82, integrally formed of synthetic resin material having high elasticity and tenacity, has a lower end formed into an engaging hook 83 and an upper end formed into an operating projection 84.

Figure 7A:
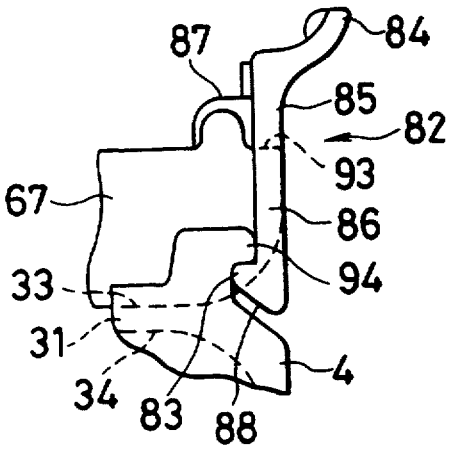
FIGS. 7(*a*) and 7(*b*) are schematic views showing a bill feeding plate opening lever disposed in the swing unit of the bill discrimination apparatus and peripheral parts in accordance with the embodiment of the present invention.
Figure 7B:
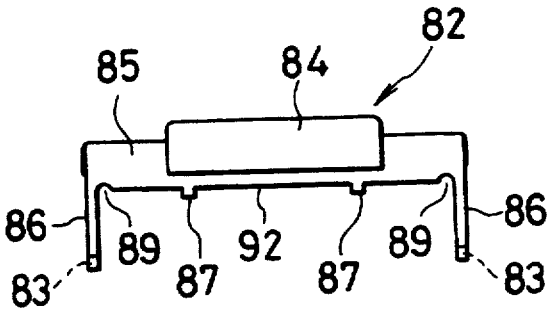
Figure 8A:
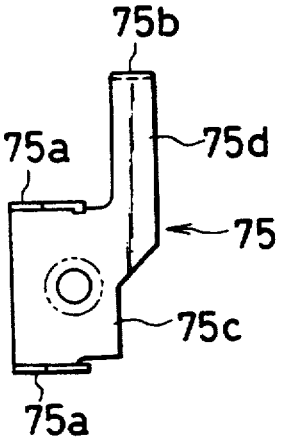
FIGS. 8(*a*), 8(*b*), 8(*c*), and 8(*d*) are views showing the configuration of a shutter member disposed in the swing unit of the bill discrimination apparatus in accordance with the embodiment of the present invention.
Figure 8B:
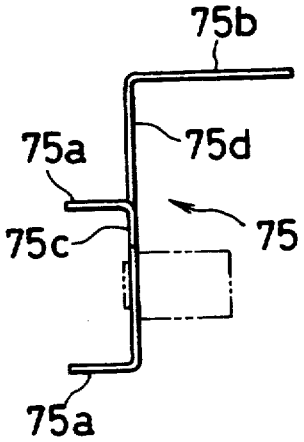
Figure 8C:
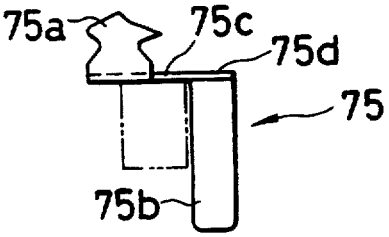
Figure 8D:
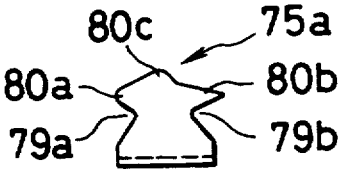

Referring now to FIGS. 7(*a*) and 7(*b*), this bill feeding plate opening lever 82 will be further explained. FIG. 7(*a*) is an enlarged side view showing only essential portions of the bill feeding plate opening lever 82, while FIG. 7(*b*) is a rear view showing the bill feeding plate opening lever 82 itself. It should be noted that FIGS. 7(*a*) and 7(*b*) have different contraction scales.

The bill feeding plate opening lever 82 includes a rectangular plate portion 85, extension arms 86, 86 extending downward from both ends of the plate portion 85, an operating projection 84 formed along a longitudinal direction of the plate portion 85 and extending upward and rearward from the center thereof to form an arc shape, and two bearing pieces 87, 87 formed at the front end of the plate portion 85 being spaced providing predetermined distance in the longitudinal direction. The engaging hook 83, formed at an end of the extension arm 86, has a tapered guide surface 88. Round cutouts 89, 89, for preventing crack, are formed at corners between the plate portion 85 and extension arms 86, 86.

To install the bill feeding plate opening lever 82 on the casing 67 which includes the first bill feeding plate 33, the casing 67 has a shaft 90 fixed at a place slightly inside from the distal end thereof as shown in FIG. 6(*a*). The bearing pieces 87, 87 of the bill feeding plate opening lever 82 are coupled around this shaft 90, while the extension arms 86, 86 of the lever 82 grip both side ends of the casing 67. As a result, the bill feeding plate opening lever 82 is rotatably installed at the swingable distal end of the casing 67 as shown in FIGS. 6(*a*) and 6(*b*).

Furthermore, a coil spring 91 is wound around the shaft 90. This coil spring 91 urges the lever 82 in a clockwise direction as shown in FIGS. 6(*a*) and 7(*a*). Swing motion of the bill feeding plate opening lever 82 in the clockwise direction is restricted within a limit shown in FIG. 7(*a*) due to interference between the lower edge 92 of the plate portion 85 and the upper edge 93 of the distal end of the casing 67. The right and left side plates 3, 4 constitute an exterior of the bill discrimination apparatus 1. In each of the insides of side plates 3 and 4, there is provided a substantially rectangular engaging piece 94 which engages with the engaging hook 83 of the bill feeding plate opening lever 82 when the casing 67 is closed to form a predetermined gap between the first and second bill feeding plates 33, 34 as shown in FIG. 7(*a*).

In more detail, when the swing unit 8 is swung in the clockwise direction about the hinge shaft 36 until it reaches the swing limit to form the bill feeding passage 31 between the first bill feeding plate 33 being the bottom of the casing 67 and the second bill feeding plate 34 as shown by a solid line of FIG. 6(*b*), the engaging hooks 83, 83 of the bill feeding plate opening lever 82 engage with the engaging pieces 94, 94 of the right and left side plates 3, 4 as shown in FIG. 7(*a*). Thus, the bottom of the casing 67, i.e. the first bill feeding plate 33, is prevented from being lifted up. In this condition, the guide rollers 69, 81 disposed on the first bill feeding plate 33 are pressed by means of spring force against the timing belts 39, 39 disposed on the side of the second bill feeding plate 34. Furthermore, the pinch rollers 41, 41 disposed on the side of the second bill feeding plate 34 are pressed against the magnetic heads 70, 70 disposed on the side of the first bill feeding plate 33, thereby enabling the insertion of a bill, automatic feeding of the bill, and reading information from the bill for discrimination. That is, normal operation of the bill discrimination apparatus 1 can be executed.

In order to remove a jammed bill or clean up various sensors and magnetic heads 70, the bill feeding passage 31 can be widely opened by pulling up the operating projection 84 of the bill feeding plate opening lever 82 with one's finger to swing the lever 82 in a counterclockwise direction as shown in FIGS. 6(*b*) and 7(*a*). This lifting action will not immediately be followed by the swing motion of the swing unit 8 because the engaging hooks 83, 83 will still remain engaged with the engaging pieces 94, 94 of the right and left side plates 3, 4.

This pulling force gives the bill feeding plate opening lever 82 a rotational moment about the bearing pieces 87, 87 in the counterclockwise direction. This is because the operating projection 84 of the bill feeding plate opening lever 82 is positioned behind (i.e. right-hand side in FIG. 7(*a*)) the bearing pieces 87, 87 which serve as a swing center of the lever 82. The rotational moment acting about the bearing pieces 87 in the counterclockwise direction will cause the bill feeding plate opening lever 82 to swing in the counterclockwise direction to disengage the engaging hook 83 from the engaging piece 94. Then, the swing unit 8 will be released from locked position, and the lifting force given to the bill feeding plate opening lever 82 comes to directly act on the swing unit 8 as a rotational moment acting about the hinge shaft 36 in the counterclockwise direction.

Consequently, the swing unit 8 will be caused to make a swing motion in the counterclockwise direction as shown in FIGS. 6(*b*) and 7(*a*). Therefore, the first bill feeding plate 33 formed at the bottom of the casing 67 separates from the second bill feeding plate 34 to open the bill feeding passage 31.

In this manner, the lifting force given to the bill feeding plate opening lever 82 not only causes the lever 82 to swing around the bearing pieces 87, 87 in the counterclockwise direction to disengage the engaging hook 83 from the engaging piece 94 but simultaneously causes the casing 67 to rotate about the hinge shafts 36, 36 in the counterclockwise direction to open the bill feeding passage 31, so that releasing the engagement of the first bill feeding plate 33 and lifting the same can be done simultaneously by simply lifting up the operating projection 84.

As apparent from the foregoing description, the swing center of the opening lever 82 of the bill feeding plate is positioned at an outside (i.e. a right side in FIG. 6(*b*)) of the hinge shafts 36, 36 which serve as a swing center of the casing 67; the bill feeding plate opening lever 82 is swung outward to disengage the engaging hook 83 from the engaging piece 94; the position of the operating projection 84 can be freely selected as long as it is positioned at an outside, i.e., right side in FIG. 6(*b*), of the swing center of the lever 82.

For closing the bill feeding passage 31, the swing unit 8 is pressed downward from the opening position (a phantom line in FIG. 6(*b*)) as is shown in the clockwise direction in FIG. 6(*b*); this first cause the bill feeding plate opening lever 82 comes into contact with upper end of the engaging piece 94 at its tapered guide surface 88. By further rotating the swing unit 8 in the clockwise direction, the tapered surface 88 is gradually pressed by the engaging piece 94. As a result, the bill feeding plate opening lever 82 rotates in the counterclockwise direction to cause the engaging hook 83 to ride on the engaging piece 94.

Further rotating the swing unit 8 will cause the engaging hook 83 to finally get over the engaging piece 94 to automatically enters the coupling recess formed under the engaging piece 94, being assisted by the urging force of the coil spring 91 acting in the clockwise direction. Consequently, the casing 67 engages with the engaging pieces 94 formed on the side plates 3, 4 through the bill feeding plate opening lever 82. In this condition, the bill feeding passage 31 is formed between the first bill feeding plate 33 constituting the bottom of the casing 67 and the second bill feeding plate 34 fixed to the side plates 3, 4. In this manner, the closing operation of the swing unit 8 for forming the bill feeding passage 31 can be carried out by the complete one-touch operation.

The closing operation of the swing unit 8 can be executed not only by pressing down the swing unit 8 but pressing down the operating projection 84 of the bill feeding plate opening lever 82. In this case, the pressing force given to the operating projection 84 prevents the bill feeding plate opening lever 82 from rotating in the counterclockwise direction when the engaging hook 83 encounters with the engaging piece 94. However, the extension arm 86 having high elasticity and tenacity can elastically deforms to bend rearward. Thus, the retracting motion of the engaging hook 83 and the motion of the engaging piece 94 for reentry into the recess can be realized.

Hereinafter, an operation of the bill discrimination apparatus 1 in this embodiment will be described briefly. When the power source of the bill discrimination apparatus 1 is turned on, a micro processor contained in the control box 10 executes circuit check and initialization while the DC motor M1 is driven for a predetermined time. During this period of time, the micro processor counts the number of pulse the rotational speed signal outputted from the rotational speed detector 61, in order to judge whether or not the speed of the timing belt 39 constituting the bill conveyor means is maintained within an appropriate speed range.

An adequate bill feeding speed is guaranteed only when the value counted during a predetermined time is in an allowable range. Thus, when this condition is fulfilled, the micro processor is then conditioned to wait an insertion of a bill. On the contrary, if the counted value is out of the allowable range, the micro processor judges that the bill feeding speed is not adequate due to some king of malfunction and stops the DC motor M1 to interrupt all the operations after generating alarm. Hereinafter, explanation will be made as to the processing in the case where the adequate bill feeding speed is guaranteed.

First, when a user inserts a bill into the bill insertion hole 23 provided on the bezel 14 of the front mask 2, the inside surface of the upper bezel 14*a*, the inclined surface of the coupling member 25, and the rib 32 formed inside the front mask 2 cooperatively guide the front end of the inserted bill, thereby causing the bill to be fed into the bill feeding passage 31 formed by the first and second bill feeding plates 33, 34.

In response to this insertion, the bill insertion sensor consisting of the light emitting element 72 and the photoelectric converter 68 operates to output an insertion detecting signal to the micro processor. Upon reception of the insertion detecting signal, the micro processor causes the DC motor M1 to rotate in a forward direction to initiate the bill feeding operation by the timing belts 39, 39 and the guide rollers 69, 81. The bill, pressed between the timing belts 39, 39 and the guide rollers 69, 69, is conveyed in the previously described bill insertion direction. When the front edge of the bill reaches the positions of the magnetic heads 70, 70, the bill passage position detecting sensor consisting of the light emitting element 73 and the photoelectric converter 71 generates an ON signal. The micro processor synchronously responds to this ON signal and activates the pull-type solenoid 74 so that the bifurcated ends 75*a*, 75*a* of the shutter member 75 retract from the bill feeding passage 31. The bill insertion sensor, consisting of the light emitting element 72 and the photoelectric converter 68, and the bill passage position detecting sensor, consisting of the light emitting element 73 and the photoelectric converter 71, detect and cooperatively determine light transmittance. Then, the micro processor starts reading this light transmittance as well as discrimination data obtained through the magnetic heads 70, 70. The collection of discrimination data is continued until the bill passage position sensor is turned OFF, i.e. until the bill entirely passes over the position of the magnetic head 70.

The pull-type solenoid 74 is deactivated when a predetermined time has elapsed after the bill passage position detecting sensor has been turned ON. The bifurcated ends 75*a*, 75*a* of the shutter member 75, however, slidably in contact with the upper surface of the bill as long as it is conveyed; therefore no part of the bifurcated end 75a protrudes downward beyond the slits of the second bill feeding plate 34. Therefore, an ON state of the shutter sensor 78 is maintained as it is.

Then, if the inserted bill entirely passes over the position of the magnetic heads 70, 70, and the bill passage position detecting sensor is turned OFF, the micro processor judges the genuineness, counterfeit or kind of the inserted bill on the basis of the collected discrimination data. If the inserted bill is genuine, the micro processor outputs a money signal corresponding to the kind of the bill to a vending or game machine. Subsequently, the DC motor M1 is driven in the forward direction for a predetermined period of time to recover the bill. Thereafter, the micro processor returns to the initial waiting condition.

When the inserted bill entirely passes over the shutter member 75, the bifurcated ends 75a, 75a of the shutter member 75 enter into the slits of the second bill feeding plate 34 due to weight of the movable core and urging force of the automatic return spring. Therefore, the bill feeding passage 31 is closed. On the other hand, if the bill is judged to be counterfeit, the micro processor causes the DC motor M1 to rotate in the reverse direction for a predetermined period of time to return the bill to the user. Thereafter, the micro processor returns to the initial waiting condition. In this case, the bifurcated ends 75a, 75a of the shutter member 75 enter into the slits of the second bill feeding plate 34 at the time when the opposite edge of the returning bill entirely passes over the shutter member 75. Then, the bill feeding passage 31 is closed.

On the contrary, if the bill passage position detecting sensor is turned on again before the shutter sensor 78 is turned OFF, no money signal will be outputted from the micro processor. More particularly, in such a case, after executing necessary processing similar to that in the returning operation of the counterfeit bill, the micro processor returns to the initial waiting condition.

This operation is effective to surely prevent the pilferage by use of string or adhesive tape. Because, the pilferage is normally done during a limited period of time ranging from the time when the collection of genuine bill information from the inserted bill is completed to the time when the bifurcated ends 75a, 75a of the shutter member 75 are entered into the slits of the second bill feeding plate 34, that is, the stage before the pilferage of the bill by the user becomes impossible.

As this invention may be embodied in several forms without departing from the spirit of essential characteristics thereof, the present embodiment is therefore illustrative and not restrictive, since the scope of the invention is defined by the appending claims rather than by the description preceding them, and all changes that fall within meets and bounds of the claims, or equivalence of such meets and bounds are therefore intended to embraced by the claims.

What is claimed is:

1. A bill discrimination apparatus comprising:

first and second bill feeding plates confronting each other to form a bill feeding passage having a predetermined clearance therebetween; and a bill conveyor means equipped in said bill feeding passage and a detecting means for discriminating a bill conveyed by said bill conveyer means; wherein said first bill feeding plate is hingedly supported at its base end on said second bill feeding plate;

a bill feeding plate opening lever is hingedly supported with a shaft on the swingable end of said first bill feeding plate, urged by a spring means in the same direction as a closing direction of the first bill feeding plate and provided with an engaging hook at its one end and an operating projection at the other end; and an engaging piece formed on an exterior member of said apparatus for engaging with the engaging hook of said bill feeding plate opening lever so that said first bill feeding plate can be positioned to form said bill feeding passage.

2. A bill discriminating apparatus comprising:

a swing unit swingably supported on an exterior member forming a main body, said swing unit comprising a casing, a bill discriminator means provided in the casing and a bottom surface of said casing formed into a first bill feeding plate;

a second bill feeding plate being fixed to said exterior member;

said swing unit being cooperative with said second bill feeding plate to form a bill feeding passage having a predetermined clearance when said swing unit is swung in a closing direction to make said first bill feeding plate confront said second bill feeding plate;

an opening lever swingably supported at a distal end of said casing and having an engaging hook at one end thereof and an operating projection at the other end thereof;

an urging means for urging said opening lever in the same direction as said closing direction of said swing unit;

said operating projection is provided in such a manner that said opening lever causes a swing motion in a reverse direction to said closing direction against urging force of said urging means when a force for opening said swing unit is given to said operating projection; and an engaging piece, provided on said exterior member, being engaged with said engaging hook of said opening lever to prevent said swing unit from swinging so that said first and second bill feeding plates form the bill feeding passage.

3. A bill discrimination apparatus in accordance with claim 2, wherein said opening lever includes an almost rectangular base plate, extension arms extending downward from right and left sides of said base plate, a plurality of bearing pieces extending toward said casing from above said base plate, and an operating projection formed on an upper end of said extension arm and projecting from above said casing in the direction reverse to a direction toward said casing; and each said extension arms has a lower end being formed into said engaging hook protruding toward said casing; further comprising:

a shaft laterally provided in said casing at a place adjacent to said distal end for rotatably supporting said bearing pieces; and wherein:

said urging means comprises a spring wound around said shaft for urging said engaging hook at the lower end of the extension arm of opening lever toward said casing.

4. A bill discrimination apparatus in accordance with claim 3, wherein said engaging hook has a tapered guide surface so that, when said swing unit is closed, said opening lever rotates in the reverse direction against urging force of said spring.

* * * * *

UNITED STATES PATENT AND TRADEMARK OFFICE

CERTIFICATE OF CORRECTION

PATENT NO. : 5,377,805

DATED : January 3, 1995

INVENTOR(S) : Takashi Ono, et al.

It is certified that error appears in the above-identified patent and that said Letters Patent is hereby corrected as shown below:

On the title page,

Item [54] Title of Invention: Change "Bill Discriminating Apparatus" to --BILL DISCRIMINATION APPARATUS--

Signed and Sealed this

Fourteenth Day of March, 1995

*Attest:*

*Attesting Officer*

BRUCE LEHMAN

*Commissioner of Patents and Trademarks*